US006201460B1

(12) United States Patent
Winslett et al.

(10) Patent No.: US 6,201,460 B1
(45) Date of Patent: Mar. 13, 2001

(54) UNDERVOLTAGE RELEASE DEVICE FOR A MOLDED CASE CIRCUIT BREAKER

(75) Inventors: Michael Troy Winslett, Marietta; Russell Bryant Green, Douglasville; Mauricio Rodriguez, Duluth; Elizabeth J. Blessitt, Peachtree City, all of GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 09/506,793

(22) Filed: Feb. 18, 2000

(51) Int. Cl.[7] ..... H01H 9/00
(52) U.S. Cl. ..... 335/172; 335/14; 335/132
(58) Field of Search ..... 335/7–14, 132, 335/167–176, 202; 202/293–308; 218/153, 154, 155

(56) References Cited

U.S. PATENT DOCUMENTS

| | | | | |
|---|---|---|---|---|
| 3,919,674 | * | 11/1975 | Acamporo et al. | 335/20 |
| 4,297,663 | | 10/1981 | Seymour et al. | 335/20 |
| 4,467,299 | * | 8/1984 | Collin et al. | 335/20 |
| 4,641,117 | * | 2/1987 | Willard | 335/7 |
| 4,675,776 | | 6/1987 | Howell | 361/92 |
| 4,706,158 | | 11/1987 | Todaro et al. | 361/92 |
| 4,743,876 | | 5/1988 | Milianowicz et al. | 335/20 |
| 4,788,621 | * | 11/1988 | Russell et al. | 361/115 |
| 4,801,907 | * | 1/1989 | Kelaita, Jr. et al. | 335/20 |
| 4,833,563 | * | 5/1989 | Russell | 361/92 |
| 4,947,284 | | 8/1990 | Munyon et al. | 361/92 |
| 5,093,643 | | 3/1992 | Altenhof, Jr. et al. | 335/20 |

* cited by examiner

*Primary Examiner*—Lincoln Donovan
*Assistant Examiner*—Tuyen T. Nguyen

(57) ABSTRACT

An undervoltage release device for a circuit breaker is disclosed having an operating mechanism, a trip bar, line and load terminals, and a cover. The device includes a housing, a solenoid, upper and lower actuators aligned with a plunger of the solenoid and in selective contact with the trip bar, plunger and actuator reset levers mounted upon the solenoid frame, and pair of terminals in electrical contact with the solenoid coil and line terminals of the breaker, wherein the force of the solenoid corresponds to the line voltage. Also disclosed is a method for tripping a circuit breaker when line voltage drops below a selected value, in a circuit breaker having an operating mechanism and a trip unit with an intermediate latch. The method includes steps of closing the circuit breaker with the operating mechanism, installing the device in a cover of the circuit breaker, the device having a solenoid with a plunger and a plurality of actuators in selective contact with the plunger and the trip unit; and wiring the solenoid in parallel with the load circuit, wherein the magnetic force of the solenoid is proportional to the line voltage and maintains the plunger in contact with the actuators, and wherein the plunger is released by the solenoid when the line voltage drops below the selected value, thereby providing for at least one actuator to contact the trip unit and open the circuit breaker.

20 Claims, 8 Drawing Sheets

UNDERVOLTAGE RELEASE DEVICE FOR A MOLDED CASE CIRCUIT BREAKER

FIELD OF THE INVENTION

The present invention relates generally to the field of circuit breakers and more particularly to a molded case circuit breaker with an undervoltage release device.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

A typical industrial circuit breaker will have a continuous current rating ranging from as low as 15 amps to as high as 400 amps. The tripping mechanism for the breaker usually consists of a thermal overload release and a magnetic short circuit release. The thermal overload release operates by means of a bimetallic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as for the period of time that current is flowing. For a given range of current ratings, the bi-metal cross-section and related elements are specifically selected for such current range resulting in a number of different circuit breakers for each current range.

In the event of current levels above the normal operating level of the thermal overload release, it is desirable to trip the breaker without any intentional delay, as in the case of a short circuit in the protected circuit, therefore, an electromagnetic trip element is generally used. In a short circuit condition, the higher amount of current flowing through the circuit breaker activates a magnetic release which trips the breaker in a much faster time than occurs with the bi-metal heating. It is desirable to tune the magnetic trip elements so that the magnetic trip unit trips at lower short circuit currents at a lower continuous current rating and trips at a higher short circuit current at a higher continuous current rating. This matches the current tripping performance of the breaker with the typical equipment present downstream of the breaker on the load side of the circuit breaker.

In certain situations, it may be advantageous to disconnect an electrical system by opening a circuit breaker in the circuit. Such circumstances can include applications for maintenance and control. It may also be used in applications to prevent use of electrical equipment under a specified or selected voltage. One device used for tripping a circuit breaker because low voltage is detected is an undervoltage release accessory. The undervoltage release accessories currently used have several disadvantages. Some such undervoltage release accessories must be installed in the circuit breaker housing behind the main cover and in close proximity to electrically live parts and connections. Further examples of present undervoltage release accessories are designed to be used with a single circuit breaker frame, i.e., for each current rating of the circuit breaker a specially designed undervoltage release accessory is required.

Thus, there is a need for an undervoltage release accessory to open a circuit breaker that can be installed in the main cover of the circuit breaker without exposing the electrically live parts of the circuit breaker. There is a further need for an undervoltage release device that can be used with several circuit breaker frame sizes, that is a single undervoltage release device that will operate over a wide range of current ratings for the circuit breaker. There is an additional need for an undervoltage release device with which a customer can connect its control wiring directly to the undervoltage release device without any additional rewiring. And further, there is a need for an undervoltage release device for a circuit breaker that can be installed in a circuit breaker utilizing a common latching protrusion that provides a noticeable snap fit installation.

SUMMARY OF THE INVENTION

The present invention provides an undervoltage release device for a molded case circuit breaker having an operating mechanism, a trip bar, a line terminal, a load terminal, and a cover. The undervoltage release device comprises a housing, a solenoid assembly having a coil, a plunger, and a frame. It further includes upper and lower actuators pivotally mounted on a solenoid frame, aligned with a plunger, and in selective contact with a trip bar; a plunger reset lever pivotally mounted on the solenoid frame and having a plunger reset tab engaged with the plunger and having a reset member; and an actuator reset lever pivotally mounted on a solenoid frame and having a plurality of tabs, with at least one tab in contact with the upper actuator, at least one tab in contact with the lower actuator, at least one tab in contact with the operating mechanism, and at least one tab in contact with a plunger reset lever. The present invention also includes a pair of terminals mounted on the accessory housing and in electrical contact with a solenoid coil and a line terminal side of the circuit breaker, wherein the magnetic force of the solenoid coil is proportional to line voltage on the circuit breaker.

Another embodiment of the present invention provides a molded case circuit breaker including a molded housing provided with a breaker cover, a first terminal and a second terminal mounted in the case, a contact electrically coupled to the first terminal, and a movable contact electrically coupled to the second terminal. It also includes an operating mechanism having a pivoting member movable between an ON position, an OFF position, and a TRIPPED position, wherein the pivoting member is coupled to the movable contact; an intermediate latching mechanism mounted in the housing and coupled to the operating mechanism; and a trip unit having a trip bar and coupled to the movable contact in the second terminal with the trip unit in selective operative contact with the intermediate latching mechanism. This embodiment also includes an accessory pocket formed in the breaker cover on either side of an opening for the pivoting member, with the accessory pocket in communication with the housing and configured to accept a plurality of different types of accessories; a latching protrusion in the pocket for engaging an accessory; a removable accessory cover sized to cover the accessory mounted in the accessory pocket; and an undervoltage release device installed in the pocket. The undervoltage release device includes an accessory housing, a solenoid assembly having a coil, a plunger, and a solenoid frame mounted in the accessory housing; an upper actuator pivotally mounted on the solenoid frame and aligned with the plunger, with the upper actuator in select contact with the trip bar; a lower actuator pivotally mounted on the solenoid frame and aligned with the plunger, with the lower actuator in selective contact with a trip bar; a plunger reset lever pivotally mounted on the solenoid frame and being engaged with the plunger and having a reset member; an actuator reset lever pivotally mounted on the solenoid frame and having a plurality of tabs, with at least one tab in contact with the upper actuator, at least one tap in contact with the lower actuator, and at least one tab in contact with the operating mechanism, and at least one tab in contact with the plunger reset lever; and a pair of terminals mounted on the accessory housing and an electrical contact with the solenoid coil and the line terminal side of the molded case circuit breaker, wherein the magnetic force of the solenoid is proportional to line voltage on the circuit breaker.

Another embodiment of the present invention provides a method for tripping a molded case circuit breaker, the circuit breaker having an operating mechanism configured to open and close the power circuit, and a trip unit with an intermediate latch and a main breaker cover, when the voltage in the power circuit drops below a selected value. The method for tripping includes the steps of closing the circuit breaker with the operating mechanism, installing the undervoltage release device in the circuit breaker cover, the undervoltage release device having a solenoid with a plunger and a plurality of actuators in selective contact with the trip bar in the trip unit; and wiring the solenoid in parallel with the power circuit, wherein the magnetic force of the solenoid is proportional to the voltage in the power circuit and maintains the plunger in contact with the actuators. When the voltage in the power circuit drops below the selected value, the plunger is released by the solenoid thereby providing for at least one actuator to contact the trip bar and open the circuit breaker.

Another embodiment of the present invention provides a circuit breaker. The circuit breaker includes a molded housing including a base and a cover, a means for connecting a load to the circuit breaker, mounted in the housing; a means for connecting an electrical line to the circuit breaker; and a means for coupling electrically to the means for connecting an electrical line. This embodiment also includes a movable means for connecting the means for connecting an electrical line to a means for operating mounted in the housing coupled with the means for operating having a pivoting member movable between an ON position, an OFF position, and a TRIPPED position, with the pivoting member coupled to the movable means for contacting and with the means for operating coupled to an intermediate means for latching the means for operating. This embodiment further includes the means for tripping coupled to the movable means for contacting and the means for connecting a load with the intermediate means for latching, wherein the means for tripping includes a means for releasing under a short circuit condition and a means for releasing under an overload condition; and a second means for tripping the circuit breaker when voltage across the electrical line drops to the lowest selected value with the second means for tripping mounted in a compartment in the cover and operatively connected to the means for tripping.

DETAILED DESCRIPTION OF THE PREFERRED EMBODIMENTS

Figure 1:
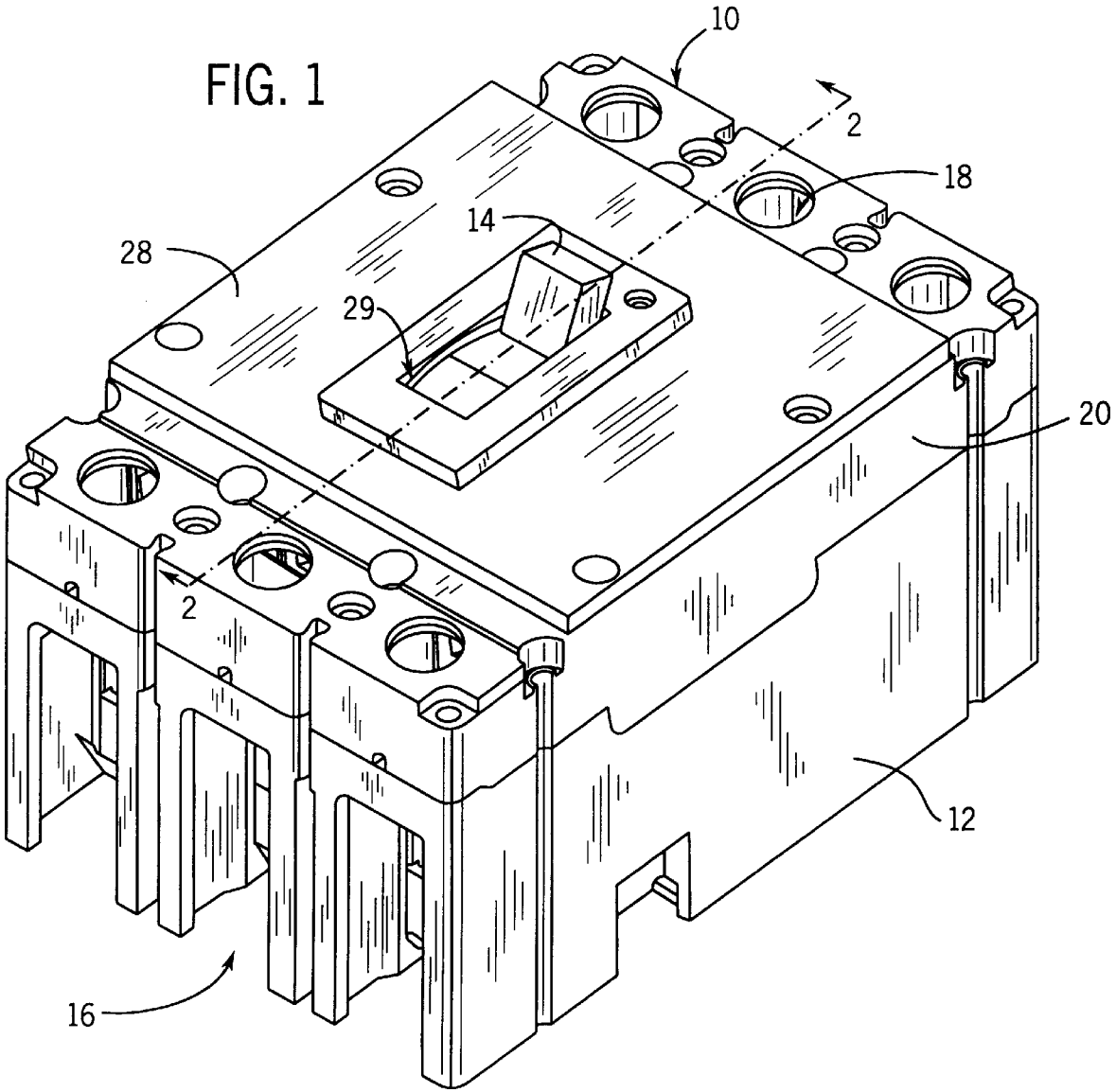
FIG. 1 is an isometric drawing of a molded case circuit breaker which includes an embodiment of the present undervoltage release unit capable of broad rating applications.

FIG. 1 generally illustrates a three phase molded case circuit breaker 10 of the type which includes an operating mechanism 40 having a pivoting member 13 with a handle 14. The pivoting member 13 and handle 14 are moveable between an ON position, an OFF position and a TRIPPED position. The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Figure 2:
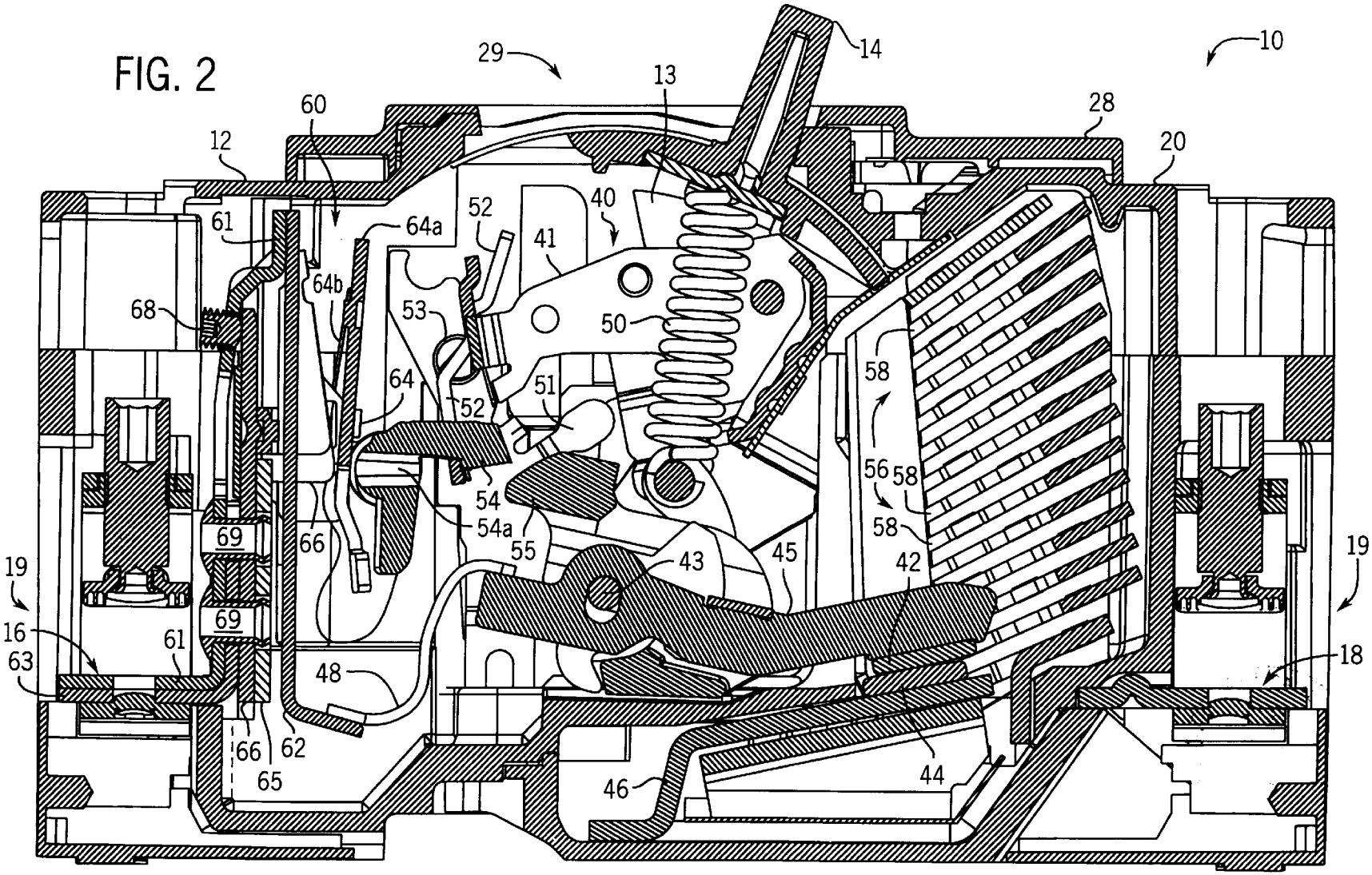
FIG. 2 is a section view of the circuit breaker shown in FIG. 1 along the lines 2—2 and is used to describe the operation of the circuit breaker.

Referring to FIG. 2., handle 14 is operable between the ON and OFF positions to enable a contact operating mechanism 40 to engage and disengage a moveable contact 42 and a stationary contact 44 for each of the three phases, such that the line terminal 18 and load terminal 16 of each phase can be electrically connected. The circuit breaker housing 12 includes three portions which are molded from an insulating material. These portions include a circuit breaker base 12*a*, a circuit breaker cover 20 and a removable accessory cover 28 with breaker cover 20 and the accessory cover 28 having an opening 29 for the handle 14 of the pivoting member 13. The pivoting member 13 and handle 14 move within the opening 29 during the several operations of the circuit breaker 10. FIG. 2 is a cut away view of the circuit breaker 10 along the lines 2—2 shown in FIG. 1. As shown in FIG. 2, the main components of the circuit breaker are a fixed line contact arm 46 and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms 46, thereby making electrical contact between moveable contact pad 42 and stationary contact pad 44.

The operating mechanism 40 includes a cradle 41 which engages an intermediate latch 52 to hold the contacts of the circuit breaker in a closed position unless and until an over current condition occurs, which causes the circuit breaker to trip. A portion of the moveable contact arm 45 and the stationary contact bus 46 are contained in an arc chamber 56. Each pole of the circuit breaker 10 is provided with an arc chamber 56 which is molded from an insulating material and is part of the circuit breaker 10 housing 12. A plurality of arc plates 58 is maintained in the arc chamber 56. The arc plates facilitate the extension and cooling of the arc formed when the circuit breaker 10 is opened while under a load and drawing current. The arc chamber 56 and arc plates 58 direct the arc away from the operating mechanism 40.

The exemplary intermediate latch 52 is generally Z-shaped having an upper leg which includes a latch surface that engages the cradle 41 and a lower leg having a latch surface which engages a trip bar 54. The center portion of the Z-shaped intermediate latch element 52 is angled with respect to the upper and lower legs and includes two tabs which provide a pivot edge for the intermediate latch 52 when it is inserted into the mechanical frame 51. As shown in FIG. 2, the intermediate latch 52 is coupled to a torsion spring 53 which is retained in the mechanical frame 51 by the mounting tabs of the intermediate latch 52. The torsion spring 53 biases the upper latch surface of the intermediate latch 52 toward the cradle 41 while at the same time biasing the trip bar 54 into a position which engages the lower latch surface of the intermediate latch 52. The trip bar 54 pivots in a counter clockwise direction about an axis 54*a*, responsive to a force exerted by a bimetallic element 62, during, for example, a long duration over current condition. As the trip bar 54 rotates, in a counter clockwise direction, the latch surface on the upper portion of the trip bar disengages the latch surface on the lower portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact arms 46.

During normal operation of the circuit breaker, current flows from the line terminal 18 through the line contact arm 46 and its stationary contact pad 44 to the load contact arm 45 through its contact pad 42. From the load contact arm 45, the current flows through a flexible braid 48 to the bimetallic element 62 and from the bimetallic element 62 to the load terminal 16. (See FIG. 3) When the current flowing through the circuit breaker exceeds the rated current for the breaker, it heats the bimetallic element 62, causing the element 62 to bend towards the trip bar 54. If the over current condition persists, the bimetallic element 62 bends sufficiently to engage the trip bar surface. As the bimetallic element engages the trip bar surface and continues to bend, it causes the trip bar 54 to rotate in a counter clockwise direction releasing the intermediate latch 52 and thus unlatching the operating mechanism 40 of the circuit breaker.

Figure 3:
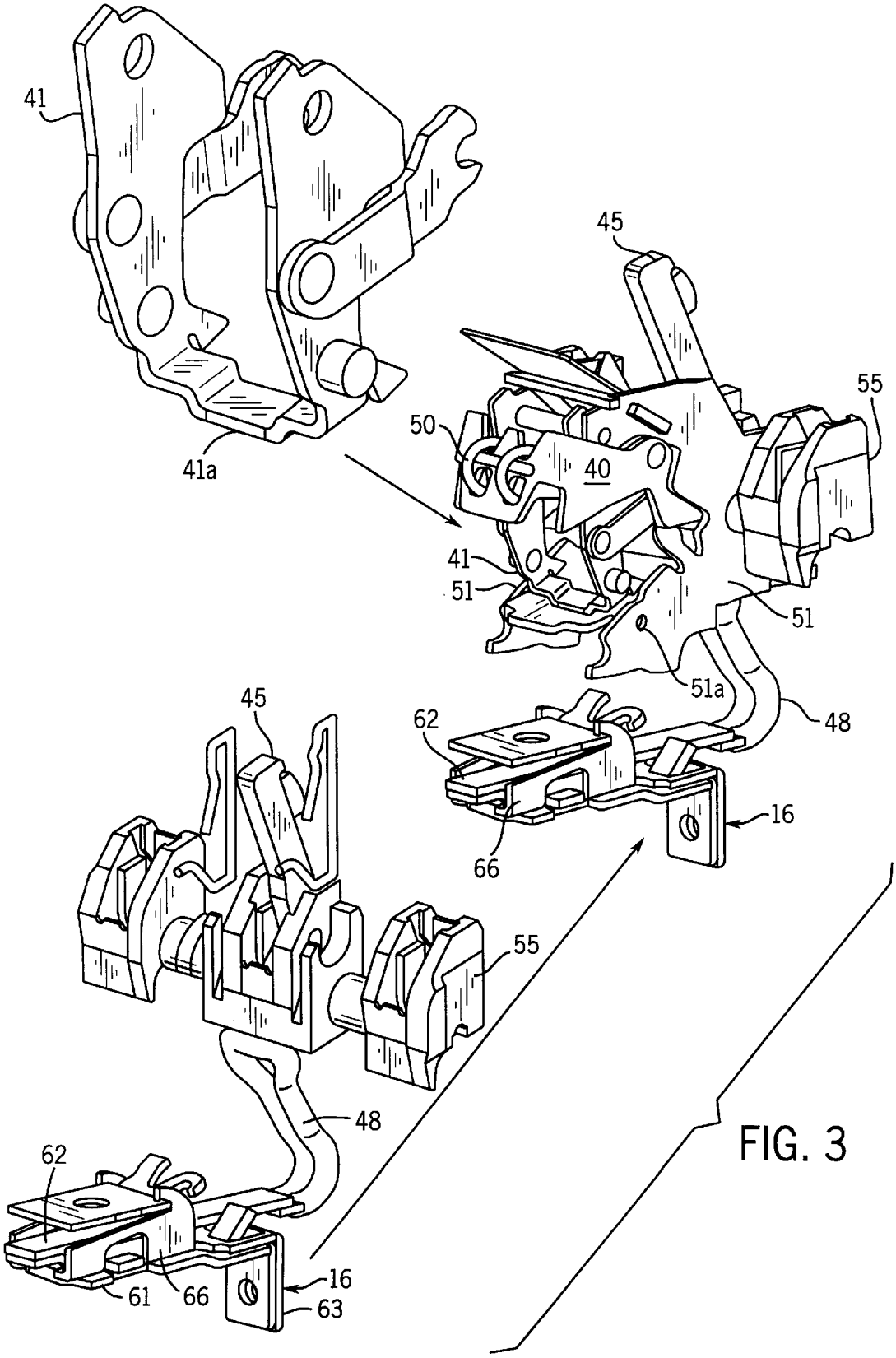
FIG. 3 is an exploded isometric drawing of the operating mechanism, contact structure and bi-metal trip unit of the circuit breaker shown in FIG. 1.

FIG. 3 is an exploded isometric drawing which illustrates the construction of a portion of the circuit breaker shown in FIG. 2. In FIG. 3 only the load contact arm 45 of the center pole of the circuit breaker is shown. This load contact arm 45 as well as the contact arms for the other two poles, are fixed in position in the cross bar element 55. As mentioned above, additional poles, such as a four pole molded case circuit breaker can utilize the same construction as described herein, with the fourth pole allocated to a neutral. The load contact arm 45 is coupled to the bimetallic element 62 by a flexible conductor 48 (e.g. braided copper strand). As shown in FIG. 3, current flows from the flexible conductor 48 through the bimetallic element 62 to a connection at the top of the bimetallic element 62 which couples the current to the load terminal 16 through the load bus 61. The load bus 61 is supported by a load bus support 63. It should be noted that more than one flexible conductor 48 may be utilized.

In the exemplary circuit breaker 10, the cross bar 55 is coupled to the operating mechanism 40, which is held in place in base 12*a* or housing 12 of molded case circuit breaker 10 by a mechanical frame 51. The key element of the operating mechanism 40 is the cradle 41. As shown in FIG. 3, the cradle 41 includes a latch surface 41*a* which engages the upper latch surface in the intermediate latch 52. The intermediate latch 52 is held in place by its mounting tabs which extend through the respective openings 51*a* on either side of the mechanical frame 51. In the exemplary embodiment of the circuit breaker, the two side members of the mechanical frame 51 support the operating mechanism 40 of the circuit breaker 10 and retain the operating mechanism 40 in the base 12*a* of the circuit breaker 10.

Figure 4:
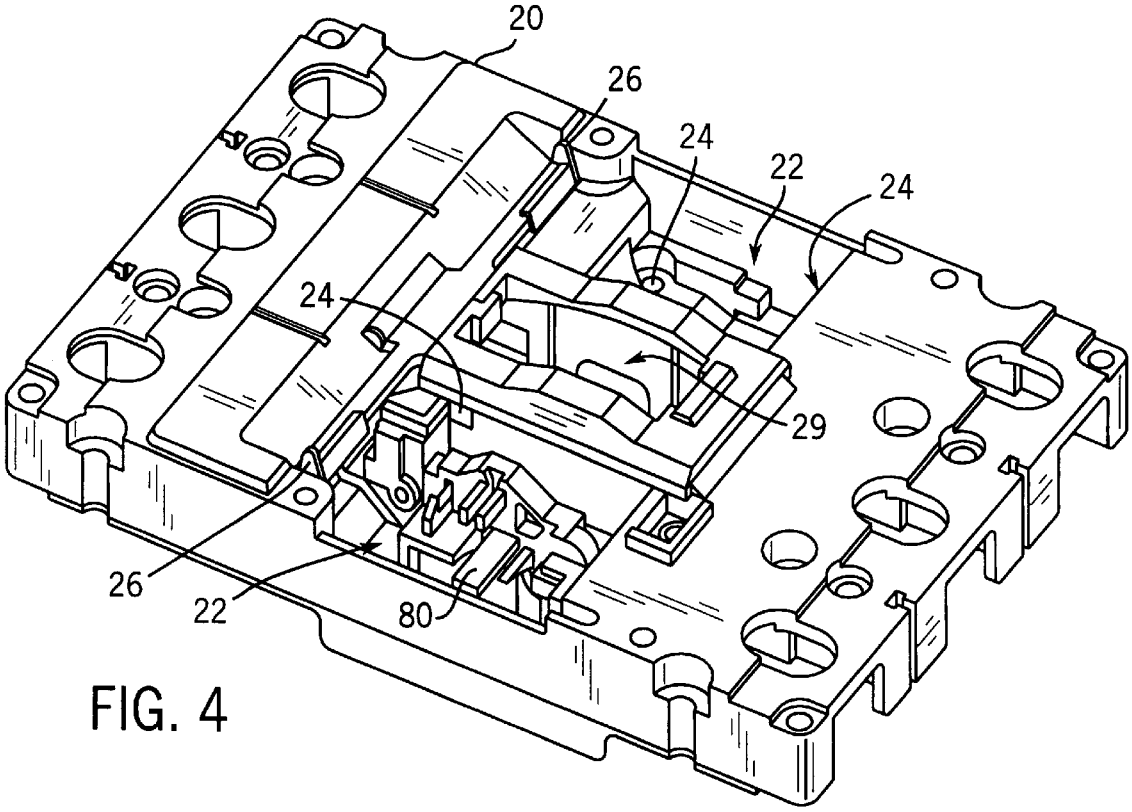
FIG. 4 is an illustration of the circuit breaker cover for the circuit breaker shown in FIG. 1.

FIG. 4 illustrates the breaker cover 20. The breaker cover 20, in the preferred embodiment, has two accessory pockets 22 formed in the cover 20, with one accessory pocket 22 on either side of the opening 29 for the pivoting member 13 and handle 14. The breaker cover 20 with the accessory pockets 22 or compartments can be formed, usually by well known molding techniques, as an integral unit. The accessory pocket 22 can also be fabricated separately and attached to the breaker cover 20 by any suitable method such as with fasteners or adhesives. The breaker cover 20 is sized to cover the operating mechanism 40, the moveable contact 42 and the stationary contact 44, as well as the trip mechanism 60 of the circuit breaker 10. The breaker cover has an opening 29 to accommodate the handle 14.

Each accessory pocket or compartment 22 is provided with a plurality of openings 24. The accessory pocket openings 24 are positioned in the pocket 22 to facilitate coupling of an accessory 80 with the operating mechanism 40 mounted in the housing 12. The accessory pocket openings 24 also facilitate simultaneous coupling of an accessory 80 with different parts of the operating mechanism 40. Various accessories 80 can be mounted in the accessory compartment 22 to perform various functions. Some accessories, such as an undervoltage release device 510, will trip the circuit breaker 10, upon detecting a voltage below a selected value, by pushing the trip bar 54, causing release of the mechanism latch 52 of the operating mechanism 40. The undervoltage release device 510 has a member protruding through one of the openings in the accessory pocket 22 and engages the operating mechanism 40, via the trip bar 54. Another accessory, such as an auxiliary switch, provides a signal indicating the status of the circuit breaker 10, e.g. "on" or "off". When the auxiliary switch is nested in the accessory pocket 22, a member on the switch assembly protrudes through one of the openings 24 in the pocket 22 and is in engagement with the operating mechanism 40, typically the cross bar 55. Multiple devices can be nested in one accessory pocket 22 and each device can engage the operating mechanism through a different opening 24 in the pocket 22.

Figure 6:
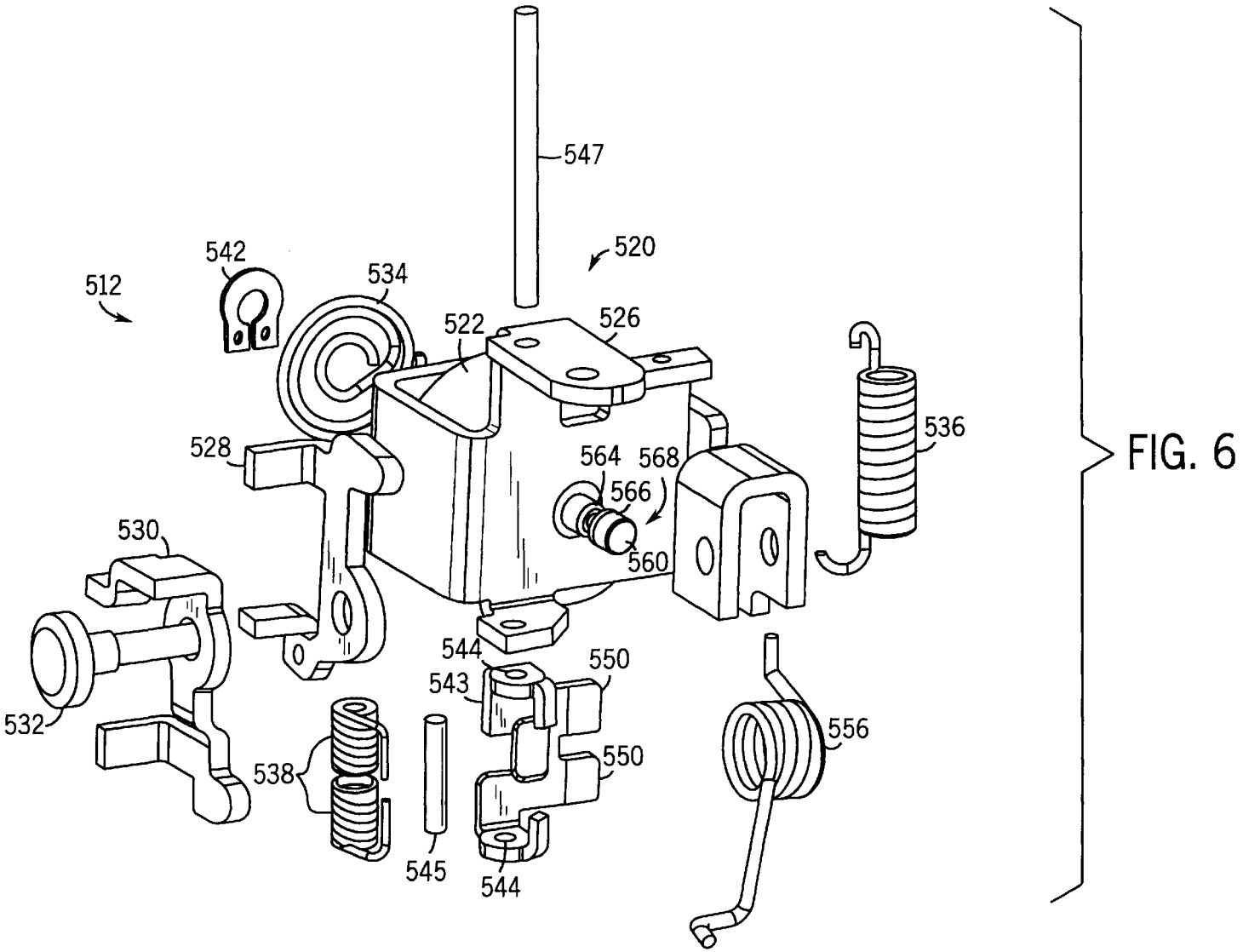
FIG. 6 is an exploded, perspective view of an embodiment of the solenoid assembly and associated actuators and bias members including a plunger reset lever.
Figure 7:
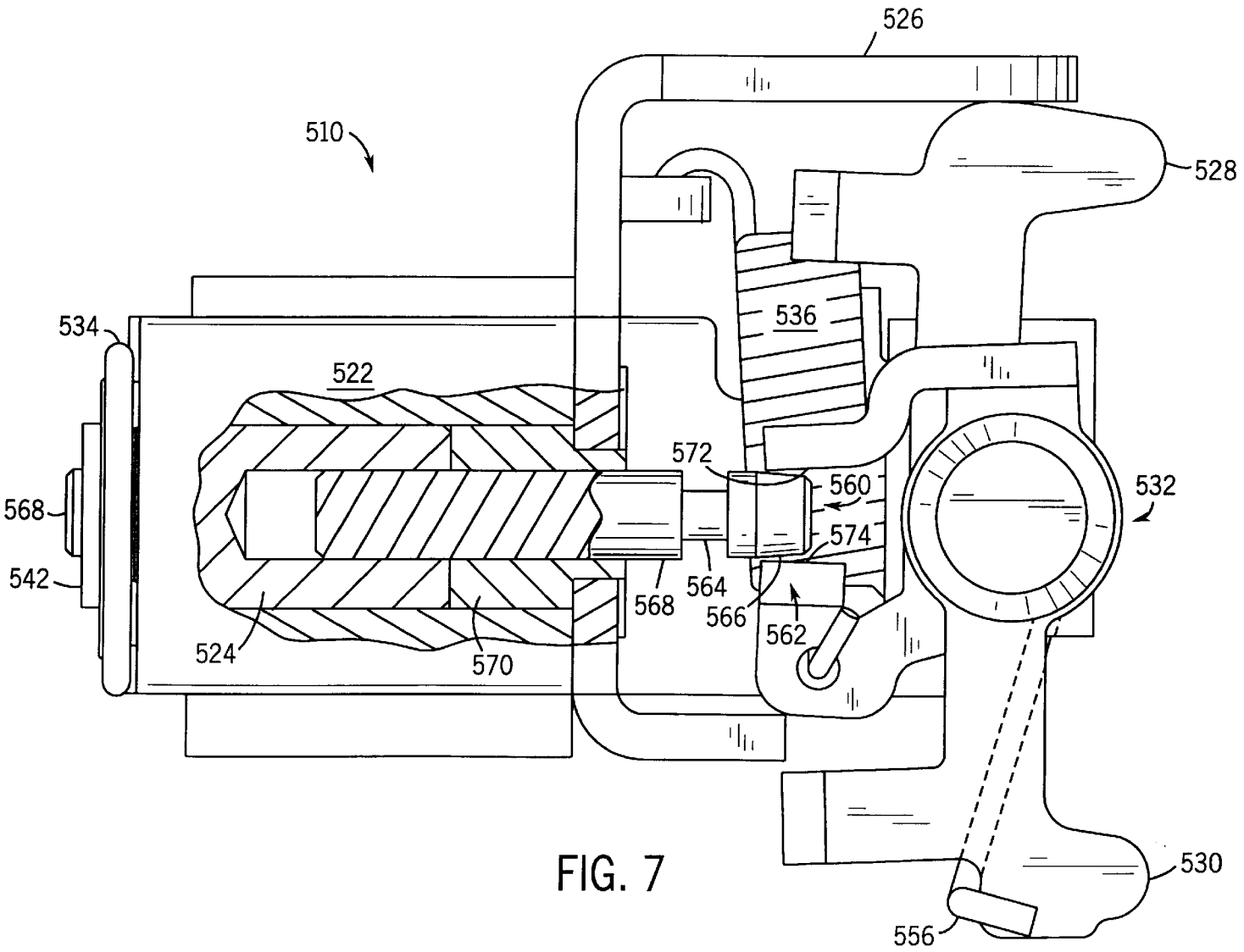
FIG. 7 is a partial sectional side view of the solenoid assembly and the associated actuators illustrated in FIG. 6, in the latched (untripped) position.
Figure 8A:
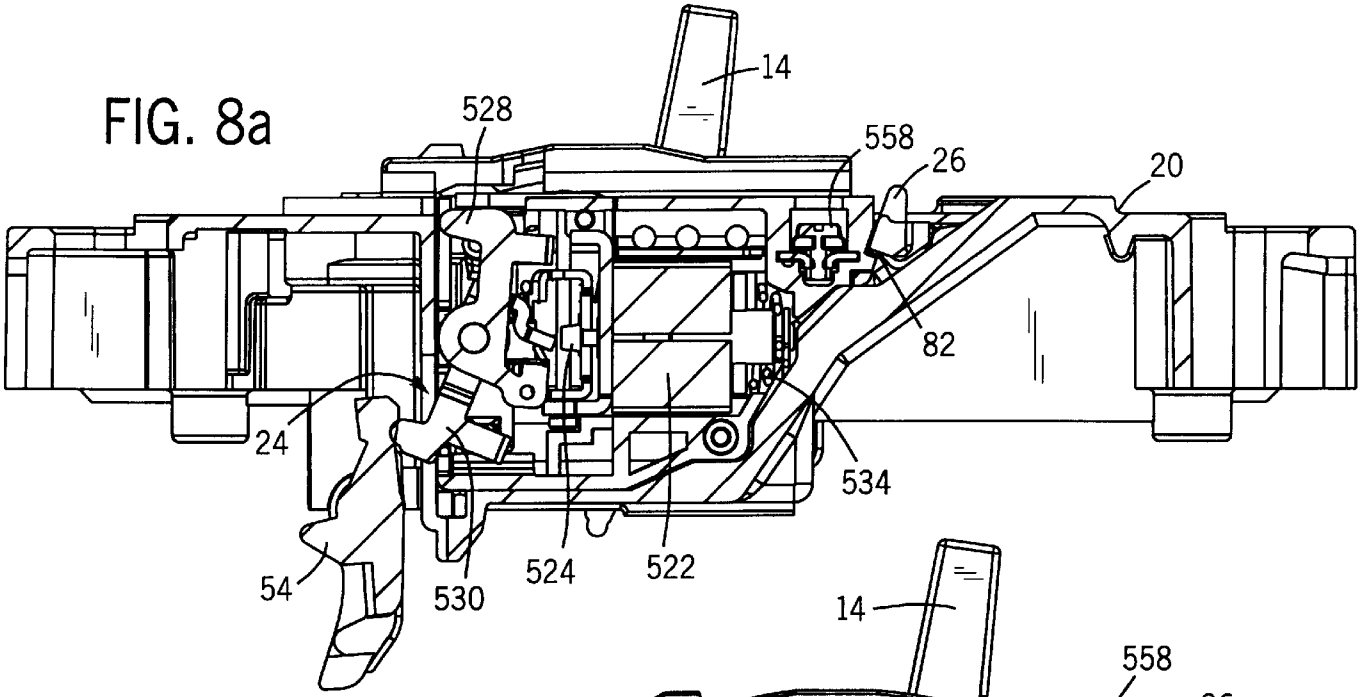
FIG. 8*a* is a partial, side sectional view of an exemplary embodiment of the undervoltage release device, nested in the accessory pocket of the breaker cover, in the unlatched (tripped) position with the lower actuator in contact with the trip bar of an embodiment of the circuit breaker through an opening in the accessory pocket.
Figure 8B:
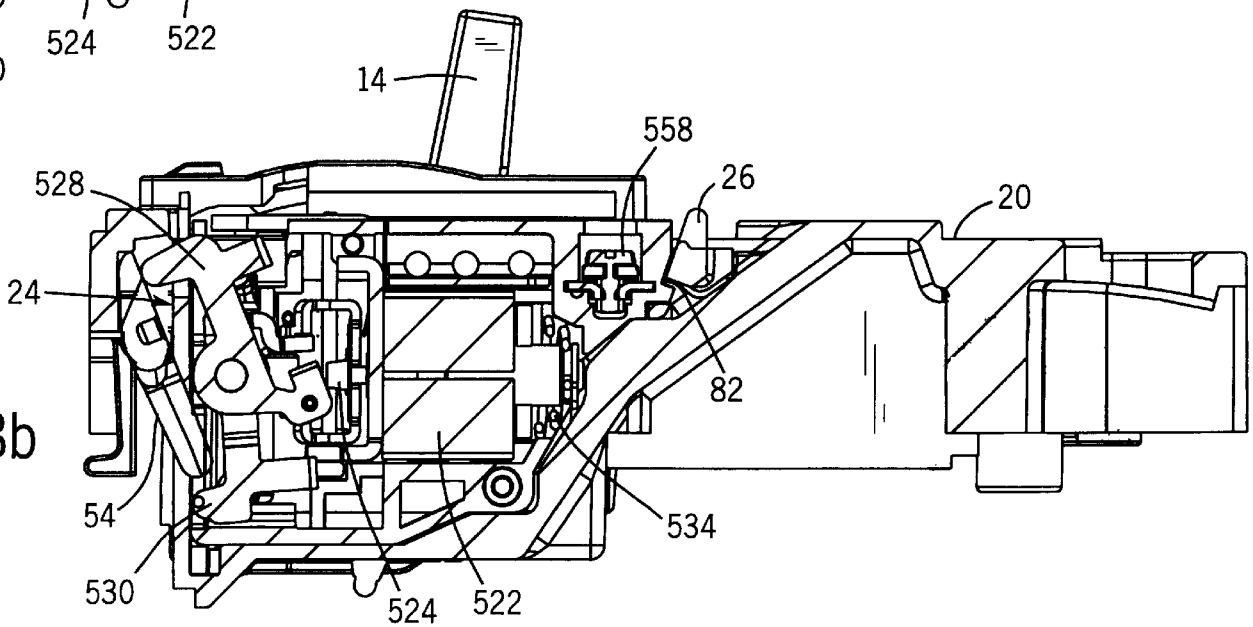
FIG. 8*b* is a partial, side sectional view of an exemplary embodiment of the undervoltage release device, nested in the accessory pocket of the breaker cover, in the unlatched (tripped) position with the upper actuator in contact with the trip bar of an embodiment of the circuit breaker through an opening in the accessory pocket.

An accessory 80 that can be inserted in the accessory pocket 22 of the cover 20 of the circuit breaker 10 is an undervoltage release device accessory 510 as shown in FIGS. 6, 7, 8*a* and 8*b*. The undervoltage release device 510 is installed in the cover as illustrated in FIGS. 4, 8*a* and 8*b* and nests in the accessory pocket 22 of the cover 20.

Figure 5:
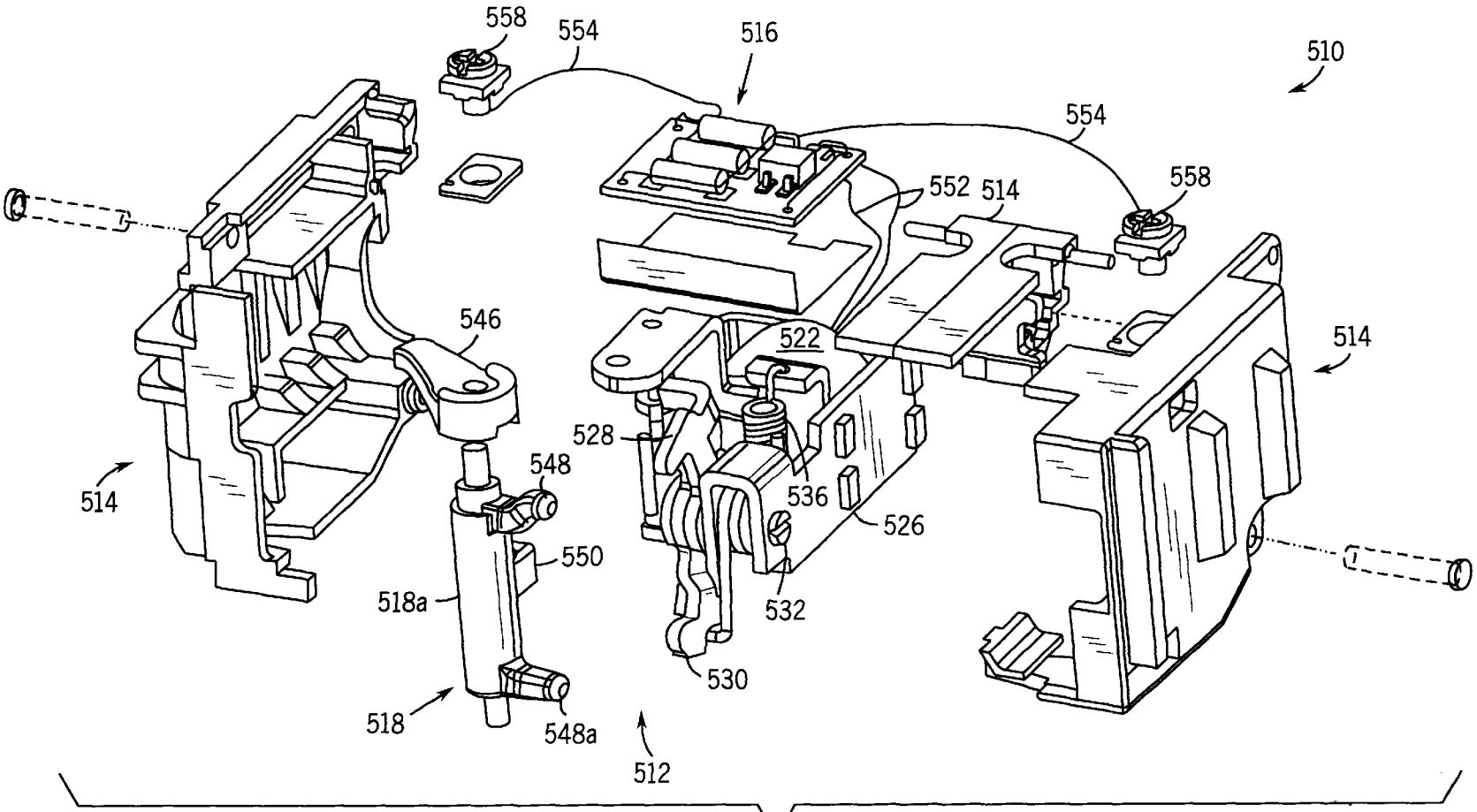
FIG. 5 is an exploded, perspective view of an exemplary undervoltage release device.

FIGS. 5, 6, and 7 illustrate undervoltage release accessory (UVRA) 510. UVRA 510 includes a trip mechanism assembly 512, a housing 514 (shown in two molded plastic halves, 514*a* and 514*b*), a circuit board assembly 516, an actuator reset lever 518, and a solenoid assembly 520.

Solenoid assembly 520 includes a solenoid frame 526, which supports trip mechanism assembly 512. Trip mechanism assembly 512 includes an upper actuator 528, a lower actuator 530, an actuator pivot 532 about which upper actuator 528 and lower actuator 530 pivot; an extension coil spring 536 for rotationally biasing upper actuator 528, and a torsional spring 556 for rotationally biasing lower actuator 530. As shown in FIG. 6, trip mechanism assembly 512 also includes a plunger coil compression spring 534 and a plunger coil spring retaining ring 542. As best shown in FIG. 7, solenoid assembly 520 includes a plunger shaft 568, a plunger shaft bearing 570, a plunger 524, and a coil 522.

A first end 560 of plunger shaft 568 includes a raised portion 566 which defines a side 564*a* of a circumferential groove 564. Raised portion 566 may include a taper 562. Extension spring 536 and torsion spring 556 are configured and disposed to pivot upper actuator 528 and lower actuator 530 about pivot 532 so that upper actuator clamping surface 572 and lower actuator clamping surface 574 are urged together. End portion 562 of plunger shaft 568 is operatively disposed between clamping surfaces 572 and 574, however, and is therefore pinched by extension coil spring 536 and torsion spring 556 through upper actuator 528 and lower actuator 530, respectively, resulting in a predetermined frictional force which is longitudinally disposed with respect to solenoid assembly 520 and tends to resist a longitudinal repositioning of plunger shaft 568.

When circuit breaker 10 is not in a tripped condition (i.e., is operatively conducting electricity from line terminal 18 to load terminal 16), a balance of longitudinally disposed forces exists upon plunger shaft 568. Retaining ring 542, secured to a second end of plunger shaft 568, restrains plunger coil compression spring 534, which has been preloaded in compression as described below. This urges plunger 524, to which plunger shaft 568 is rigidly secured, away from actuators 528, 530. The force of this urging is opposed by a predetermined force generated by solenoid assembly 520 when operating at a predetermined line voltage above, typically and for example, 70% of the nominal line voltage, and by the predetermined frictional force of the clamping surfaces 572 and 574 bearing upon tapered surface 562. When line voltage drops below the predetermined level of, e.g., 70% of nominal line voltage, solenoid forces are correspondingly reduced to a point that plunger coil spring 534 pulls plunger 524, with plunger shaft 568, out of engagement with upper actuator 528 and lower actuator 530, thus causing a tripping of circuit breaker 10 as described below. Force electromagnetically generated by solenoid assembly 520 corresponds to the voltage across terminals of coil 522 and, in a preferred embodiment, is approximately proportional to the line voltage of the protected circuit or device.

Referring now to FIGS. 5 and 6, housing members 514*a* and 514*b* are molded of a plastic material having a high dielectric constant, as well as a high level of mechanical strength and of resistance to influences such as aging, high and low temperatures, lubricating and fuel oils, cleaning compounds, etc. Housing 514 includes electrical wiring terminals 558.

FIGS. 8*a* and 8*b*, when viewed with FIG. 4, show a preferred embodiment of accessory 80. Accessory 80 is simply pushed into place in pocket 22 of accessory cover 28. Latching protrusions 26 engage an accessory detent 82, and retain accessory 80 within accessory pocket 22. Accessory 80 may be easily later removed from circuit breaker 10, if needed, by simply deflecting latching protrusion 26 toward the adjacent wall of accessory pocket 22, using any flat tool such as a straight-slot screwdriver. All wiring is accessible through opening 24 in accessory cover 28, so that accessory 80 can be installed in circuit breaker 10 without a need to remove cover 20 from housing 12.

Solenoid assembly 520 is a generally conventionally configured DC device well known to those of skill in the art, with the exceptions of including groove 564 in the region of first end 560 of plunger shaft 568. The first end 560 may also include a taper portion 562.

Circuit board assembly 516 is mounted within housing 514, and is configured to rectify AC line voltages to DC voltages for use with solenoid assembly 520. This allows UVRA 510 to be used with both AC and DC line voltages. Circuit board assembly 516 is in electrical communication with line terminals 18 through wires 554, and with solenoid assembly 520 through electrical wires 552.

Actuator reset lever 518 includes a main shaft portion 518*a*, an upper actuator reset member 548, a lower actuator reset member 548*a*, and a plunger reset tab 550. A reset lever arm 546 is affixed to an end of shaft portion 518*a*, and is configured and disposed to be operatively engaged by handle 14 or by pivoting member 13 to which handle 14 is affixed. Lever 543 pivots about a pivot pin 547, which is inserted through apertures penetrating top and bottom surfaces of a plunger reset frame 543. At least one (in the illustrated instance, two are shown) plunger reset torsion spring 538 is positioned upon a pivot pin (in the preferred embodiment, configured as a split or coiled spring pin 545) having a passageway therethrough for receiving pivot pin 547.

When handle 14 is placed in a RESET position, it bears upon reset lever arm 546 causing actuator reset lever 518 to rotate about its pivot hole. Actuator reset members 548 and 548*a* engage upper actuator 528 and lower actuator 530, respectively, and move them in directions to increase a distance between clamping surfaces 572, 574 and thereby increase preload of springs 536 and 556. Simultaneously, plunger reset lever 544, which is confined within groove 564 of plunger shaft 568, abuts and bears upon side wall 564*a* of groove 564 and thereby pulls plunger shaft 568, with plunger 524, partially out of solenoid coil 522 so that plunger coil spring 534 is compressed and preloaded, and, upon release of handle 14, tapered portion 562 of plunger shaft 568 is clamped by clamping surfaces 572, 574. Voltage applied to load terminal 16 is also applied to solenoid coil 522 (through circuit board assembly 516 and wires 552, 554, so that the force balance described above causes plunger 524, shaft 568, and actuators 528, 530 to maintain their positions as long as voltage applied to the terminals of coil 522 does not drop below the predetermined value (e.g., 70% of the nominal voltage).

UVRA 510 is configured for use in various sizes of circuit breaker. FIG. 8*a* shows UVRA 510 installed in a 125A circuit breaker, wherein lower actuator 530 engages a trip bar 54. Upper actuator 528 is not needed for this size of circuit breaker, but is simply left in place to allow economies of scale in production, distribution, and inventorying of UVRA 510 through parts commonality. Upper actuator 528 is held in place by a wall 22*a* of accessory pocket 22, so that it is not free to flop around at will.

Similarly, FIG. 8*b* shows UVRA 510 installed in a larger circuit breaker (e.g., 160A, 250A or 400*a*) wherein upper actuator 528 engages a trip bar 54 and lower actuator 530 is not used, but is retained by a wall 12*b* of circuit breaker housing 12. In both FIGS. 8*a* and 8*b*, trip bar 54 has been actuated; i.e., plunger 524 has been pulled back within solenoid coil 520 in response to a force exerted by coil spring 534, which overpowered frictional and solenoid forces due to a decrease in voltage to solenoid coil 520. In FIG. 8*a*, this has allowed torsional spring 556 to pivot lower actuator 530 about pivot 532. In FIG. 8*b*, this has allowed extension spring 536 to pivot upper actuator 528 about the major axis of pivot 532. In both cases, trip bar 54 has been actuated, causing (as shown in FIG. 2) intermediate latch 52 to disengage and load contacts 42 to disengage, mechanically and electrically, line contacts 44 as described above.

While the embodiments illustrated in the figures and described above are presently preferred, it should be understood that these embodiments are offered by way of example only. Invention is not intended to be limited to any particular embodiment, but it is intended to extend to various modifications that nevertheless fall within the scope of the intended claims. For example, it is also contemplated that the solenoid can receive a control power signal from an electronic control circuit connected to the circuit breaker. Additionally, it is also contemplated that the trip mechanism having a bi-metal trip unit or an electronic trip unit with a load terminal be housed in a separate housing capable of mechanically and electrically connecting to another housing containing the operating mechanism and line terminal thereby providing for a quick and easy change of current ratings for an application of the circuit breaker contemplated herein. Other modifications will be evident to those with ordinary skill in the art.

What is claimed is:

1. An undervoltage release device for a molded case circuit breaker having an operating mechanism, a trip bar, a line terminal, a load terminal and a cover, the undervoltage release device comprising:

an accessory housing;

a solenoid assembly having a coil, a plunger and a solenoid frame mounted in the accessory housing;

an upper actuator pivotally mounted on the solenoid frame and aligned with the plunger, with the upper actuator in selective contact with the trip bar;

a lower actuator pivotally mounted on the solenoid frame and aligned with the plunger, with the lower actuator in selective contact with the trip bar;

a plunger reset lever pivotally mounted on the solenoid frame and being engaged with the plunger and having a reset member;

an actuator reset lever pivotally mounted on the solenoid frame and having a plurality of tabs, with at least one tab in contact with the upper actuator, at least one tab in contact with the lower actuator, at least one tab in contact with the operating mechanism and at least one tab in contact with the plunger reset lever; and a pair of terminals mounted on the accessory housing and in electrical contact with the solenoid coil and the line terminal side of the molded case circuit breaker, wherein the magnetic force of the solenoid coil is proportional to line voltage on the circuit breaker.

2. The undervoltage release device of claim 1, further comprising a circuit board assembly mounted in the accessory housing and in electrical contact with the solenoid coil and the terminals, wherein the circuit board assembly energizes the solenoid coil in direct proportion to line voltage on the circuit breaker.

3. The undervoltage release device of claim 1, wherein the solenoid plunger, the plunger reset lever, the upper actuator and the lower actuator are each biased in an unlatched position by a bias member.

4. The undervoltage release device of claim 3, wherein the bias member on the solenoid plunger is a compression coil spring.

5. The undervoltage release device of claim 3, wherein the bias member on the upper actuator is an extension coil spring.

6. The undervoltage release device of claim 3, wherein the bias member on the lower actuator is a torsion spring.

7. The undervoltage release device of claim 3, wherein the bias member on the plunger rest lever is a torsion spring.

8. The undervoltage release device of claim 1, wherein the accessory housing includes an accessory detent aligned to engage a latching protrusion on the cover.

9. A molded case circuit breaker comprising:

a molded housing including a breaker cover;

a first terminal and a second terminal mounted in the case;

a contact electrically coupled to the first terminal;

a moveable contact electrically coupled to the second terminal;

an operating mechanism having a pivoting member moveable between an ON position, an OFF position and a TRIPPED position, wherein the pivoting member is coupled to the moveable contact;

an intermediate latching mechanism mounted in the housing and coupled to the operating mechanism;

a trip unit having a trip bar and coupled to the moveable contact and the second terminal with the trip unit in selective operative contact with the intermediate latching mechanism;

an accessory pocket formed in the breaker cover on either side of an opening for the pivoting member, with the accessory pocket in communication with the housing and configured to accept a plurality of different types of accessories;

a latching protrusion in the pocket for engaging an accessory;

an accessory cover sized to cover the accessories mounted in the accessory pockets; and, an undervoltage release device installed in the pocket, the undervoltage release device comprising:

an accessory housing;

a solenoid assembly having a coil, a plunger and a solenoid frame mounted in the accessory housing;

an upper actuator pivotally mounted on the solenoid frame and aligned with the plunger, with the upper actuator in selective contact with the trip bar;

a lower actuator pivotally mounted on the solenoid frame and aligned with the plunger, with the lower actuator in selective contact with the trip bar;

a plunger reset lever pivotally mounted on the solenoid frame and being engaged with the plunger and having a reset member;

an actuator reset lever pivotally mounted on the solenoid frame and having a plurality of tabs, with at least one tab in contact with the upper actuator, at least one tab in contact with the lower actuator, at least one tab in contact with the operating mechanism and at least one tab in contact with the plunger reset lever; and a pair of terminals mounted on the accessory housing and in electrical contact with the solenoid coil and the line terminal side of the molded case circuit breaker, wherein the magnetic force of the solenoid coil is proportional to line voltage on the circuit breaker.

10. The undervoltage release device of claim 9, further comprising a circuit board assembly mounted in the accessory housing and in electrical contact with the solenoid coil and the terminals, wherein the circuit board assembly energizes the solenoid coil in direct proportion to line voltage on the circuit breaker.

11. The undervoltage release device of claim 9, wherein the solenoid plunger, the plunger reset lever, the upper actuator and the lower actuator are each biased in an unlatched position by a bias member.

12. The undervoltage release device of claim 11, wherein the bias member on the solenoid plunger is a compression coil spring.

13. The undervoltage release device of claim 11, wherein the bias member on the upper actuator is an extension coil spring.

14. The undervoltage release device of claim 11, wherein the bias member on the lower actuator is a torsion spring.

15. The undervoltage release device of claim 11, wherein the bias member on the plunger reset lever is a torsion spring.

16. The undervoltage release device of claim 9, wherein the accessory housing includes an accessory detent aligned to engage a latching protrusion on the cover.

17. A circuit breaker comprising:

a molded housing including a base and a cover;

a means for connecting a load to the circuit breaker, mounted in the housing;

a means for connecting an electrical line to the circuit breaker;

a means for coupling electrically to the means for connecting an electrical line;

a movable means for contacting the means for connecting an electrical line to a means for operating mounted in the housing coupled with the means for operating having a pivoting member movable between an ON position, an OFF position, and a TRIPPED position, with the pivoting member coupled to the movable means for contacting and with the means for operating coupled to an intermediate means for latching the means for operating;

a means for tripping coupled to the movable means for contacting and the means for connecting a load with the intermediate means for latching, wherein the means for tripping includes a means for releasing under a short circuit condition and a means for releasing under an overload condition; and a second means for tripping the circuit breaker when voltage across the electrical line drops below a selected value with the second means for tripping mounted in a compartment in the cover and operatively connected to the means for tripping.

18. The circuit breaker of claim 17 wherein the compartment includes a means for retaining the second means for tripping.

19. The circuit breaker of claim 17, including a means for preventing the operation of the second means for tripping if the circuit breaker is not closed.

20. The circuit breaker of claim 19, wherein the second means for tripping will operate upon receiving a power signal from a location remote from the circuit breaker, whereby the second means for tripping will engage the means for tripping in the housing.

* * * * *